United States Patent [19]

Szydlek

[11] Patent Number: 4,655,149

[45] Date of Patent: Apr. 7, 1987

[54] OPTICAL SENSOR FOR AUTOMATIC SEWING MACHINE

[75] Inventor: Nicholas P. Szydlek, Exeter, N.H.

[73] Assignee: USM Corporation, Farmington, Conn.

[21] Appl. No.: 858,415

[22] Filed: Apr. 29, 1986

[51] Int. Cl.[4] ..... D05B 21/00

[52] U.S. Cl. ..... 112/121.12; 112/453

[58] Field of Search ..... 112/121.11, 121.12, 112/453, 454, 456, 457, 458, 262.1, 266.1, 262.3

[56] References Cited

U.S. PATENT DOCUMENTS 4,479,446 10/1984 Johnson et al. ..... 112/121.12

4,526,116 7/1985 Mannel ..... 112/121.12 X

FOREIGN PATENT DOCUMENTS

W086347 1/1986 Japan ..... 112/121.11

2131463 6/1984 United Kingdom ..... 112/121.11

*Primary Examiner*—Peter Nerbun

*Attorney, Agent, or Firm*—William F. White

[57] ABSTRACT

An optical sensor system senses encodings on workpiece holders being processed within an automatic sewing machine. The optical sensor system can reliably sense the encodings on the workpiece holders over a wide range of spaced distances dictated by workpiece holder configurations encountered within automatic sewing machine systems.

19 Claims, 4 Drawing Figures

OPTICAL SENSOR FOR AUTOMATIC SEWING MACHINE

FIELD OF THE INVENTION

This invention relates to the sensing of binary codes which identify workpieces that are to be sewn by an automatic sewing machine system. In particular, this invention relates to the optical sensing of binary codes formed on workpiece holders containing the work that is to be automatically sewn.

BACKGROUND OF THE INVENTION

U.S. Pat. No. 4,479,446 discloses an automatic sewing machine system having the capability of automatically identifying the work being processed within the system. The automatic identification is premised on the ability of the system to optically sense binary codes present on the workpiece holders containing D the work to be processed. The binary codes consist of combinations of opaque and reflective encodings which are decoded by the automatic sewing machine system as binary ones and zeroes respectively. This is accomplished by providing a pair of optical sensors which are fixedly mounted in a manner which allows the encodings of the workpiece holder to be registered underneath the optical sensors. The thus mounted optical sensors respond to the amount of light reflected from the encodings so as to thereby identify whether the encodings thereunder are either opaque or reflective.

It has been found that the ability of each of the optical sensors to correctly identify the encoding appearing underneath is dependent on how much variance occurs in the spacing of the encoding from the particular optical sensor. In this regard, workpiece holders that are of approximately the same thickness present encodings to the sensors that are spaced at approximately the same distance from the sensors. This rather uniform spacing between encodings and sensors allows for the sensing circuitry associated with the sensors to be adjusted so as to appropriately respond to the amount of light coming from an opaque encoding versus a reflective encoding. In this manner, the thus mounted optical sensors within the system disclosed in U.S. Pat. No. 4,479,446 adequately sense the amount of light reflected from the encodings so as to thereby identify the encodings appearing on the presented workpiece holders.

It is to be appreciated, however, that workpiece holders used within automatic sewing machine systems may vary significantly in thickness due to the type of work that is being processed within the automatic sewing machine. In this regard, a workpiece holder may consist of one or more leafs each containing a separate overlay of work that has to be sewn to certain work located underneath. An example of such a workpiece holder is illustrated in U.S. Pat. No. 3,988,993, entitled "Pallet for Registering and Securing A Workpiece Which Includes Overlays". The varying thickness of the composite workpiece holder in this patent causes the top encodings to be spaced at varying distances from the fixedly mounted sensors in U.S. Pat. No. 4,479,446. It has been found that the amount of light reflected from such variably spaced encodings can sometimes produce false readings by the fixedly mounted sensors of U.S. Pat. No. 4,479,446. In particular, it has been found that light being reflected from an opaque encoding located at a minimum distance from a sensor could sometimes cause the sensing circuit associated with the sensor to identify the encoding as being reflective if the sensing circuit had been previously adjusted to trigger in response to approximately the same amount of light being received from a reflective encoding located at the maximum distance from the sensor. When the sensing circuit was further adjusted so as to not respond to this amount of light, then the reflected light coming back from the reflective encoding located at the maximum distance was sometimes insufficient to allow the sensing circuit to appropriately identify the encoding as being reflective.

OBJECTS OF THE INVENTION

It is an object of this invention to provide an optical sensing arrangement in an automatic sewing machine system which reliably senses binary codes appearing on workpiece holders.

It is another object of this invention to provide o an optical sensing arrangement for use within an automatic sewing machine system which accurately senses codes appearing on workpiece holders at variably spaced distances from the optical sensing arrangement.

SUMMARY OF THE INVENTION

The above and other objects are achieved according to the present invention by an optical sensing system comprising a pair of photosensitive transistors located above the place where encodings of a workpiece holder are to be presented within the automatic sewing machine system. The photosensitive transistors are part of a sensing circuit which also includes a pair of light emitting diodes that are sequentially activated so as to thereby successively illuminate the encodings of the workpiece holding device at a predefined frequency. The amount of reflected light from the thus illuminated encodings produces conductive responses in the photosensitive transistors. Circuitry associated with the photosensitive transistors is operative to assign a binary significance to the conductive state of each photosensitive transistor during such time as the encoding is being illuminated by a light emitting diode. This results in bi-level output signals from the circuitry indicative of the opaque or reflective nature of each encoding appearing on the workpiece holder.

In accordance with the invention, a pair of bias lamps illuminate the encodings of the workpiece holder so as to thereby define a predetermined amount of reflective light back to the photosensitive transistors. This predefined amount of reflected light provides a bias to the photosensitive transistors so as to allow the circuitry associated with the photosensitive transistors to further respond to the light reflected from the encodings as a result of high frequency illumination by the light emitting diodes. The sensitivity of the circuitry is sufficient to distinguish an opaque encoding from that of a reflective encoding over a broad range of spacings of the encodings with respect to the photosensitive transistors.

BRIEF DESCRIPTION OF THE DRAWINGS

The above and other features of the invention will now be particularly described with reference to the accompanying drawings, in which:

FIG. 4 i11ustrates signals within the circuitry of FIG. 3. de

DESCRIPTION OF THE PREFERRED EMBODIMENT

Figure 1:
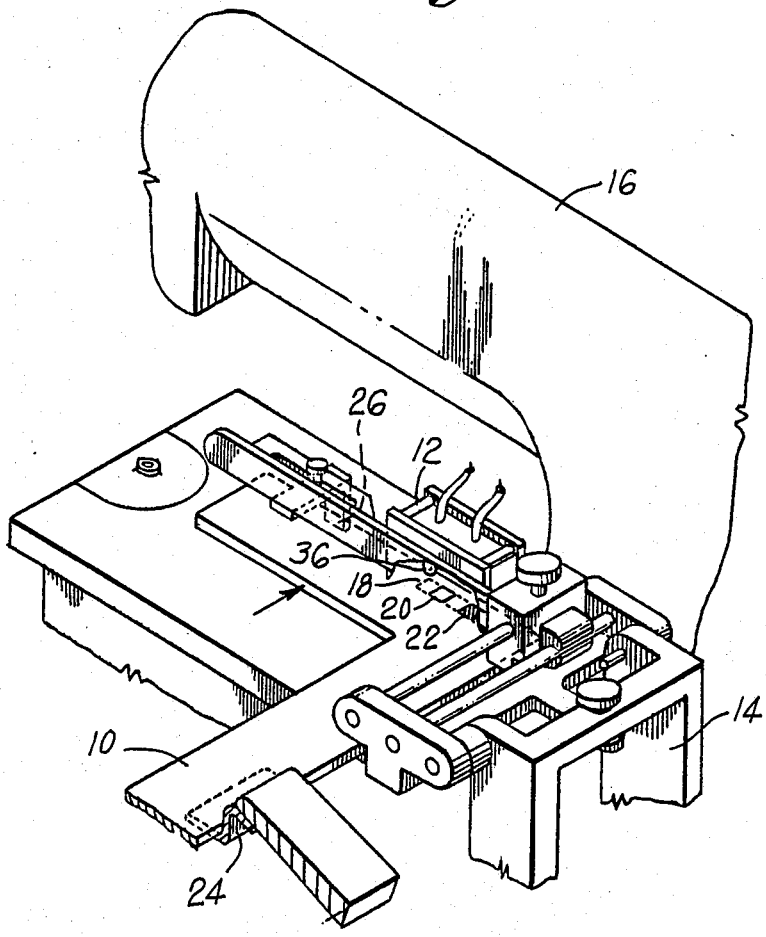
FIG. 1 is an overall perspective view of a workpiece holding device having encodings registered with respect to an optical sensing device within an automatic sewing machine system.

Referring to the FIG. 1, a corner of a workpiece holder 10 is illustrated relative to a sensing device 12 fixedly mounted to structure 14 adjoining a sewing head 16. The workpiece holder 10 normally contains a workpiece (not shown) which is to be automatically sewn by the sewing head 16. The pattern which is sewn on the workpiece is accessed from an electronic memory as a result of the sensing device reading a workpiece holder identification code 18 appearing on the workpiece holder 10. The workpiece holder identification code 18 may consist of two separate encodings 20 and 22. The encoding 20 is reflective whereas the encoding 22 is opaque. The encodings are preferably adhesive backed materials with an appropriate hard surface finish that allows for normal wear and usage in a shoe production environment. The material used in the preferred embodiment is a Fasson "Crack and Peel Plus" high gloss sixty pound white available from Fasson Specialty Materials Division, Painesville, Ohio. The reflective encoding 20 is the aforementioned white material in unaltered form. The opaque encoding 22 is preferably the white material coated with a black ink identified as Sonagloss —VS374 process black available from Vanson Holland Ink Corporation of America, Mineola, N.Y.

It is to be appreciated that various combinations of encodings may occur within the workpiece holder identification code 18. Each combination of encodings could be used to uniquely identify a particular workpiece holder. A system is disclosed in the U.S. Pat. No. 4,479,446 which can read the various combinations of encodings and access a stitch pattern from memory which has been previously assigned to the particular combination of encodings.

The encodings 20 and 22 are precisely registered with respect to optical sensors within the sensing device 12 by an edge guide 24 and a rear edge stop 26. The edge guide 24 may be a part of a supporting shelf structure which receives the workpiece holding device 10 at a location above the sewing position. This receiving location can be used to optically sense the encodings 20 and 22 prior to processing the workpiece holder device to a sewing position within the automatic sewing machine. Such a receiving location including the supporting shelf structure is disclosed in detail in U.S. Pat. No. 4,479,446. It is to be understood, however, that optical sensing of the workpiece holder identification code may occur in other locations within an automatic sewing machine system. Any such optical sensing merely requires accurate registration of the workpiece holder 10 relative to the optical sensing device 12.

Figure 2:
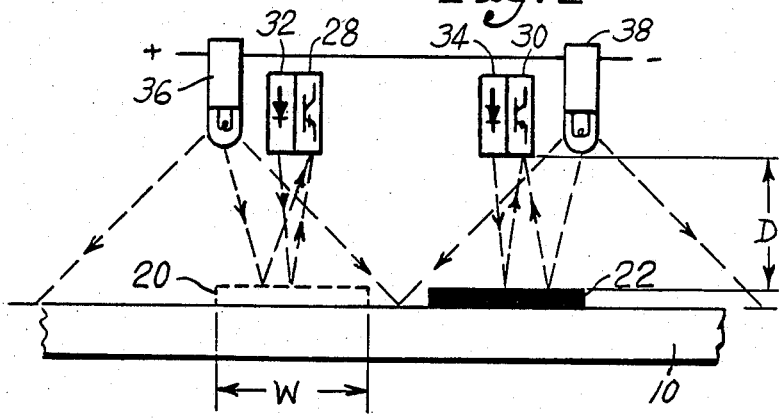
FIG. 2 i11ustrates the relationship of the various elements within the optical sensing device of FIG. 1 relative to the encodings on the workpiece holder.

Referring now to FIG. 2, the encodings 20 and 22 are illustrated relative to a pair of photosensitive transistors 28 and 30. A light emitting diode 32 associated with the photosensitive transistor 28 is located above the encoding 20 whereas a light emitting diode 34 associated with the photosensitive transistor 30 is located above the encoding 22. Each photosensitive transistor and associated diode is preferably a unit assembly identified as an OPB 706B available from TRW Optron Electronics Division of TRW, Inc., Carrollton, Tex. It is to be understood that the photosensitive transistors 28 and 30 as well as the light emitting diodes 32 and 34 are fixedly mounted within the sensing device 12. The sensing device 12 is in turn fixedly mounted above the workpiece holding device 10 by the support structure 14 in FIG. 1. On the other hand, the workpiece holder 10 is supported in a plane defined by the lower portion of the shelf 24 in FIG. 1 as well as other supporting shelf structure. Referring to FIG. 2, it is to be appreciated that the distance, "D" of the encodings 20 and 22 from the photosensitive transistors 28 and 30 will depend on the thickness of the workpiece holder 10. In the preferred embodiment, this spacing can vary between three hundred seventy-five thousandths (0.375) of an inch and seven hundred fifty thousandths (0.750) of an inch. It is to be understood that the light emitting diodes 32 and 34 are capable of fully illuminating the encodings 20 and 22 beneath the photosensitive transistors 28 and 30 over this range of spaced distances. It is to be furthermore noted that the Width, "W" of each encoding is preferably sixty-two hundredths (0.62) of an inch whereas the length is preferably one (1.0) inch.

The encodings 20 and 22 are furthermore illuminated by a pair of bias lamps 36 and 38 fixedly mounted within the sensing device 12. The bias lamps are preferably #7370PS available from Sylania Miniature Lighting Products, Inc., Hillsboro, N.H. These lamps are connected in series to a power supply voltage of fifteen volts d.c. so as to provide seven and one-half (7.5) volts per lamp. The bias lamps 36 and 38 fully illuminate the encodings 20 and 22 upon registration of the workpiece holder 10 with respect to the sensing device 12.

Figure 3:
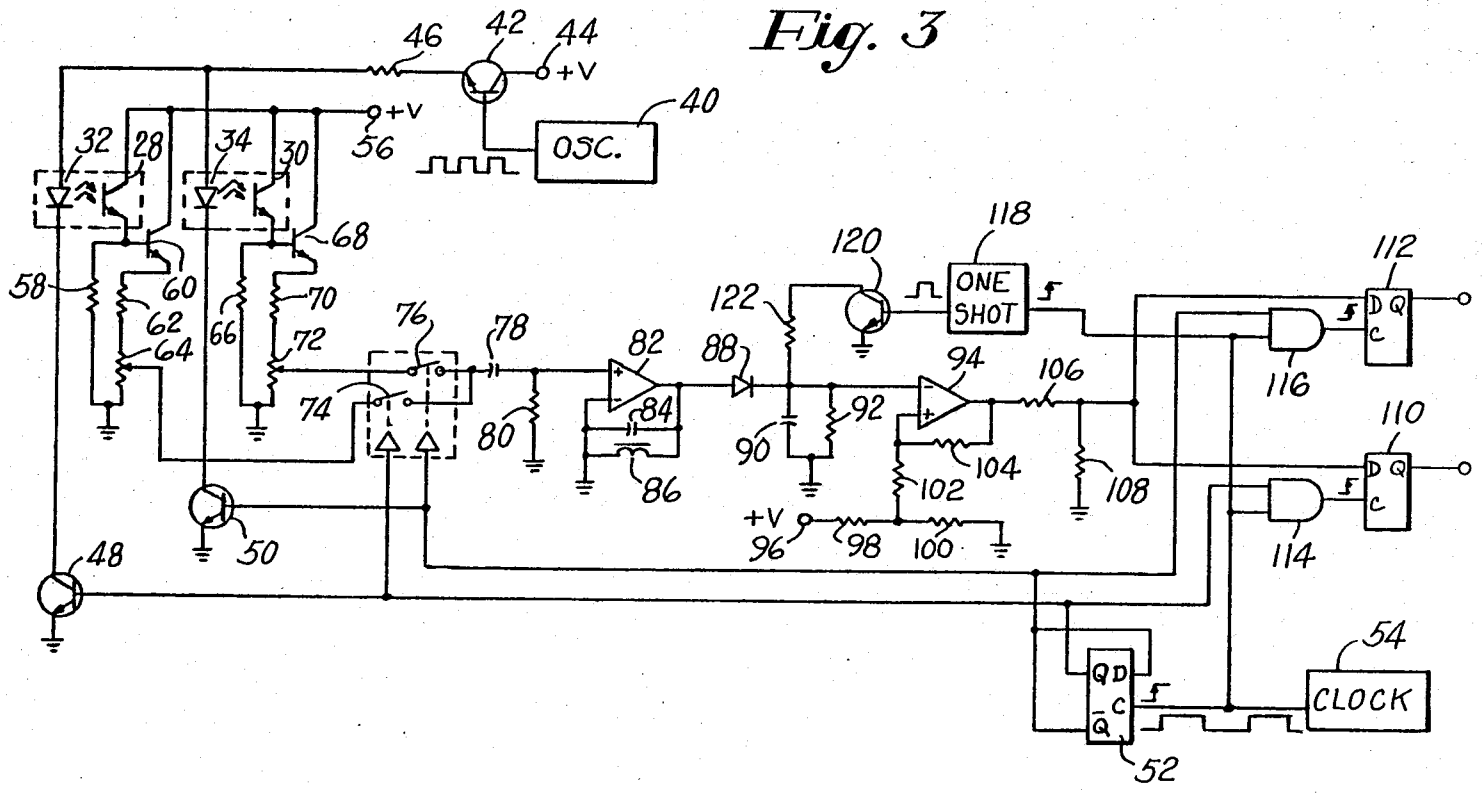

Referring now to FIG. 3, the circuitry used to control the light emitting diodes 32 and 34 and to respond to the photosensitive transistors 28 and 30 is illustrated. The light emitting diodes are subject to a drive current having a frequency defined by a nine kilohertz oscillator 40 operating through a base activated transistor 42. The drive current is defined by a voltage source 44 as well as a resistor 46 upstream of each light emitting diode. Each light emitting diode is selectively subjected to the aforementioned drive current by a selectively activated downstream transistor 48 or 50. The base of each downstream transistor is connected to an output of a D type flip-flop circuit 52. The negation output of the flip-flop is fed back to the D input so as to cause the flip-flop 52 to toggle in response to a five hertz clock signal from a clock circuit 54. In this manner, a logically high signal is always present at either the base of the transistor 48 or the base of the transistor 50. This allows each light emitting diode to be alternately conductive at the nine kilohertz frequency dictated by the oscillator 40.

The thus activated light emitting diode 32 or 34 will impose a reflected light condition on the photosensitive transistor 28 or 30 associated therewith. The conductive response of each photosensitive transistor to the reflected light is defined by the conductive path for that particular transistor. The conductive path for each photosensitive transistor begins with a positive voltage source at a terminal 56 upstream of each photosensitive transistor. The downstream conductive path of the photosensitive transistor 28 is through a resistor 58 to ground as well as through the base of an amplifying transistor 60 which is connected to ground through a resistor 62 and a tapped resistor 64. The downstream conductive path of the photosensitive transistor 30 is through a resistor 66 as well as through the base of an amplifying transistor 68 which is connected to ground through a resistor 70 and a tapped resistor 72.

It is to be noted that each photosensitive transistor will have a given threshold conductance (or resistance) when light is being received from a reflective encoding located at the maximum spaced distance from the photosensitive transistor. This threshold conductance must be distinctly more than the conductance of the photosensitive transistor when receiving reflected light from the opposite opaque encoding at the minimum spaced distance from the photosensitive transistor. It has been found that the conductive sensitivity of each photosensitive transistor to the above noted situations is greatly enhanced by providing the biased lighting from the bias lamps 36 and 38. The bias lamps effectively provide a d.c. level of conductance from which the additionally imposed a.c. levels of conductance contributed by the reflective light from the light emitting diodes can be accurately distinguished within the critical range of conductive responses to the differently reflected lighting conditions. The above biased lighting is sufficient when the bias lamps are subjected to seven and one-half volts so as to provide approximately seven thousandths (0.007) of mean spherical candle power over the range of spaced distances for the encodings relative to both the light emitting diodes and the photosensitive transistors.

Referring again to the tapped resistors 64 and 72, it is to be noted that the voltages defined by the tapped points on these resistors must be substantially the same for the aforementioned threshold conductances of the respective photosensitive transistors. This allows the conductive state of each photosensitive transistor to be meaningfully interrogated by circuitry which will now be described. A pair of switches 74 and 76 are operative to impress voltage conditions occurring at the tapped points of resistors 64 and 72 upon a resistor - capacitor combination comprising a capacitor 78 and a resistor 80. The switches 74 and 76 are preferably DG-202 switches available from Analog Devices, Incorporated of Norwood, Mass. It is to be noted, however, that any responsive switching arrangement including relay switches would also suffice. These switches are responsive to the paired output signal conditions of the flip-flop circuit 52. It will be remembered that the output signal conditions of the flip-flop circuit 52 also separately activate the downstream transistors 48 and 50 associated with the light emitting diodes 32 and 34. The switch 74 will hence be operative to impress the voltage condition from the tapped point on the resistor 64 at the same time that the light emitting diode 32 has been subjected to the high frequency drive current. On the other hand, the switch 76 will be operative to impress the voltage condition from the tapped point on the resistor 72 at the same time that the light emitting diode 34 has been subjected to the high frequency drive current. In this manner, the switches 74 and 76 are merely operative to impress the resulting voltage condition from the corresponding photosensitive transistor when the light emitting diode associated therewith has been turned on.

The capacitor 78 in combination with the resistor 80 is operative to apply the alternating current portion of the thus received signal to a band pass filter comprising differential amplifier 82 in combination with capacitive feedback 84 and inductive feedback 86. This band pass filter configuration is operative to effectively allow only the nine kilohertz portion of the signal therethrough. This filtered signal is applied to a diode 88 which functions as a half wave rectifier. The thus rectified signal is applied to a capacitor 90 and a resistor 92. This resistor - capacitor configuration integrates the half wave rectified signal from the diode 88 and produces a d.c. voltage level signal. This d.c. voltage level is compared with a predefined voltage level in a differential amplifier 94. This latter voltage is set by dividing a positive voltage at a terminal 96 by resistors 98, 100 and 102. The high gain output of the differential amplifier 94 is fed back to the positive input via a feedback resistor 104. The output of the differential amplifier 94 will be a relatively low voltage condition when the input voltage thereto reflects a high level of conductivity on the part of the photosensitive transistor then under evaluation. The output will rise when the input voltage to the differential amplifier 94 is low reflecting a low level of conductivity on the part of the photosensitive transistor then under evaluation. The output voltage in either of the above situations is divided by resistors 106 and 108 so as to provide an appropriate logic level voltage to either a latch circuit 110 or a latch circuit 112.

In addition to receiving the appropriate logic level voltage, each latch circuit also receives an input signal from an AND gate associated therewith. In this regard, the latch circuit 110 receives an input signal from an AND gate 114 whereas the latch circuit 112 receives an input signal from an AND gate 116. Each AND gate is operative to produce a positive going input signal to its respective latch circuit when appropriately enabled by the flip-flop circuit 52. Only one AND gate will be so enabled at any one time. The thus enabled AND gate will gate a positive going clock pulse from the clock circuit 54. The latch circuit receiving the thus gated positive going pulse will latch onto the logic level voltage that has been applied thereto. It is to be appreciated that the enabling signals for the AND gates 114 and 116 are the same as the enabling signals that are applied to the switches 74 and 76. It is hence to be appreciated that the latch circuit 110 will ultimately respond to the output voltage from the differential amplifier 94 when the switch 74 is closed. On the other hand, the latch circuit 112 will ultimately respond to the output voltage from the differential amplifier 94 when the switch 76 is closed. The latched logic level voltage will, of course, be logically low for a low voltage output from the differential amplifier and logically high for a high voltage output from the differential amplifier. Since the output of the differential amplifier 94 is low in response to a relatively conductive photosensitive transistor, then the latch circuit associated with the switch for that particular photosensitive transistor will be latched low. The reverse will occur for a relatively non-conductive photosensitive transistor.

It is noted that the clock signal from the clock circuit 54 that is applied to the aforementioned AND gates 114 and 116 is also applied to a one-shot circuit 118. The one-shot circuit 118 triggers on the leading edge of each positive going clock pulse so as to produce a pulse of predetermined duration. This latter pulse is applied to the base of a transistor 120. The thus activated transistor discharges the capacitor 90 through resistor 122 causing the voltage upstream of the input to the differential amplifier to drop significantly. The output of the differential amplifier will assume a high signal state at this time preparatory to responding to the next input signal condition caused by the activation of switch 74 or switch 76.

Figure 4:
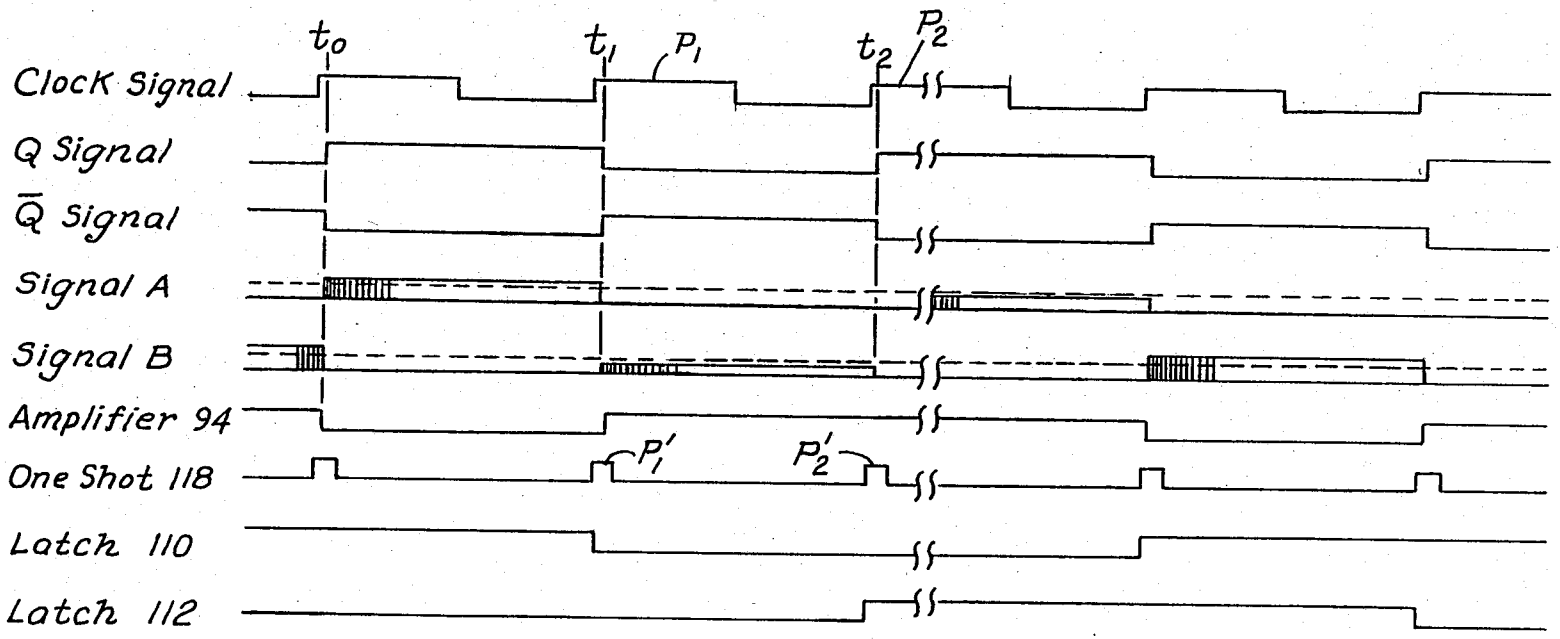
FIG. 4 illustrates the circuitry associated with the optical sensing elements of FIG. 2.

The operation of the circuitry illustrated in FIG. 3 will now be discussed relative to certain signals occurring therein. These signals are illustrated in FIG. 4 beginning with the clock signal from the clock circuit 46. The clock signal is preferably a periodic pulse train having a frequency of five hertz. The signals produced by the flip-flop circuit 52 in response to the clock signal are next illustrated as the Q and $\overline{Q}$ signals. The leading edges of the Q and $\overline{Q}$ signals are slightly offset from corresponding leading edges of the clock signal by virtue of the slight propagation delay occurring in the flip-flop circuit. The Q signal selectively activates the switch 48 which in turn causes the light emitting diode 32 to produce light at the frequency dictated by the oscillator 40. The nine kilohertz light from the light emitting diode 32 reflects off of the reflective encoding 20 and causes the photosensitive transistor 28 to become highly conductive. This produces a rectified high frequency signal A in FIG. 4 occurring at the output of the diode 88 as a resu1t of the switch 74 being closed between times $t_o$ and $t_1$. The amplitude of the high frequency signal A exceeds the predefined threshold voltage (indicated by dotted line) occurring at the positive input of the differential amplifier 94. This causes the output of the differential amplifier 94 to remain low between times $t_o$ and $t_1$. This signal state ultimately sets the latch circuit 110 low when the leading edge of the clock pulse labeled $P_1$ is applied thereto through the AND gate 114. The resulting signal state of the latch circuit 110 is illustrated in FIG. 4. It is to be noted that the leading edge of the clock pulse $P_1$ also triggers the one shot-circuit 118 which produces a pulse $P'_1$ illustrated in FIG. 4. This pulse $P'_1$ activates the transistor 120 which initializes the voltage level occurring at the negative input to the differential amplifier 4. The output of the differential amplifier 94, therefore, switches high as indicated in FIG. 4. The circuitry of FIG. 3 is now ready to respond to the reflected light from the opaque encoding 22. In this regard, the $\overline{Q}$ signal from the flip-flop 52 activates the light emitting diode 34. The opaque encoding 22 reflects a relatively low amount of light back to the photosensitive transistor 30. This in turn produces a rectified high frequency signal B in FIG. 4 occurring at the output of the diode 88 as a result of switch 76 being closed between times $t_1$ and $t_2$. The amplitude of the high frequency signal B does not exceed the predefined voltage (indicated by dotted line relative to signal B) occurring at the positive input to the differential amplifier 94. This causes the output of the differential amplifier to remain high. This output signal state from the differential amplifier ultimately causes the latch circuit 112 to be set logically high. This occurs when the leading edge of the positive going clock pulse $P_2$ is gated through the AND gate 116 and applied to the trigger input of the latch circuit 112. This is indicated by the switch signal state in the output signal for the latch circuit 112 in FIG. 4 occurring shortly after the leading edge of the clock pulse $P_2$ also triggers the one-shot 122 so as to produce a pulse $P_2$. The leading edge of the clock pulse $P'_2$ also triggers the one shot 122 so as to produce a pulse $P'_2$ which initializes the input voltage to the differential amplifier 94. At this time, the outputs of the latch circuits 110 and 112 may be read as appropriately indicating the binary value assigned to the reflective encoding 20 and the opaque encoding 22. In this regard, the latch circuit 110 indicates a binary zero for the reflective encoding 20 whereas the latch circuit 112 indicates a binary one for the opaque encoding 22. This is the binary encoding scheme for opaque and reflective encodings utilized by the system for automatically identifying and processing workpieces disclosed in U.S. Pat. No. 4,479,446. The code sensing FIG. 3 could hence be used directly with the system of U.S. Pat. No. 4,479,446.

Referring again to FIG. 4, it is to be noted that a break occurs in all signals following time $t_2$. This is to indicate an elapse of time before the next workpiece holder is presented to the automatic sewing machine system of FIG. 1. The encodings for this next workpiece holder are encoded exactly opposite to the encodings 20 and 22. In other words, the encoding corresponding to encoding 20 is now opaque whereas the encoding corresponding to the encoding 22 is now reflective. This produces the various signal conditions occurring after time $t_2$ in FIG. 4.

Referring to FIG. 3, the following are the preferred values or identifications for the labeled circuit elements:

transistor 42: 2N3020
voltage source 44: +15 volts d.c.
resistor 46: 50 ohms
transistors 48, 50: ULN 2003A
flip-flop circuit 52: 74LS74
voltage source 56: +15 volts d.c.
resistors 58, 66: 27 kilo ohms
resistors 62, 70: 8.2 kilo ohms
resistors 64, 72: 10 kilo ohms
capacitor 78: 0.01 micro farads
resistor 80: 22 kilo ohms
capacitor 84: 0.033 micro farads
inductance 86: 10 milli Henrys
diode 88: 1N456
capacitor 90: 0.47 micro farads
resistor 92: 22 kilo ohms
differential amplifier 94: LM358
voltage source 96: +15 volts d.c.
resistor 98: 12 kilo ohms
resistor 100: 3 kilo ohms
resistor 102: 1 kilo ohm
resistor 104: 100 kilo ohms
resistor 106: 22 kilo ohms
resistor 108: 15 kilo ohms
flip-flop circuit 110, 112: 74LS74
one-shot circuit 118: NE555
transistor 120: 2N3904
resistor 122: 100 ohms ki From the foregoing, it is to be appreciated that a preferred embodiment of an optical sensor system for use with an automatic sewing machine has been disclosed. It is to be appreciated that alternative logic within the disclosed system may be substituted for elements of the preferred embodiment without departing from the scope of the invention.

What is claimed is:

1. A system for optically sensing encodings appearing on workpiece holders being processed by an automatic sewing machine, said system comprising:

means for continuously illuminating the encodings when presented to the automatic sewing machine;

means for intermittently illuminating the encodings at a predefined frequency;

means for sensing the amount of reflected light from the encodings; and means, responsive to said sensing means, for assigning a binary value to the sensed amount of reflected light from each of the encodings.

2. The system of claim 1 further comprising:

means for locating a workpiece holder in static relationship to said means for sensing the amount of reflected light from the encodings whereby the encodings on the workpiece holder may vary in spaced vertical distance therefrom.

3. The system of claim 1 wherein said means for intermittently illuminating the encodings at a predefined frequency comprises:

at least one light source projecting light at the predefined frequency onto an encoding located directly underneath; and wherein said means for continuously illuminating the encodings comprises:

at least one lamp spaced from the light source so as to project light on the encoding underneath the light source over a predetermined range of allowed spacings between the light emitting diode and the respective encoding.

4. The system of claim 1 further comprising:

means for selectively activating said means for intermittently illuminating the encodings and said means for sensing the amount of reflected light from the encodings whereby only one encoding is intermittently illuminated and the amount of light reflected therefrom is sensed at any one time.

5. The system of claim 1 further comprising:

means for selectively connecting said means for sensing the amount of reflected light from the encodings to said means for assigning a binary value to the sensed amount of light from each of the encodings.

6. The system of claim 5 wherein said means for assigning a binary value to the sensed amount of reflected light from each of the encodings comprises:

means responsive to said selectively connecting means, for producing an appropriate bi-level signal indicating the assigned binary value immediately prior to termination of the selective connection by said selectively connecting means.

7. The system of claim 1 wherein said means for assigning a binary value comprises:

means, responsive to said means for sensing the amount of reflected light from the encodings, for producing a voltage condition indicative of the amount of sensed light; and means for adjusting the produced voltage condition so as to define a first voltage condition indicative of the amount of reflected light from a first type of encoding appearing at a minimum spaced distance from said sensing means and to define a second voltage condition indicative of the amount of reflected light from a second type of encoding at a maximum spaced distance from said sensing means.

8. The system of claim 7 wherein said means for assigning a binary value further comprises:

means for defining a threshold voltage relative to said first and second voltage conditions;

means for comparing the produced voltage condition from said means for responding to said sensing means with the threshold voltage condition; and means, responsive to said comparing means, for assigning a first binary value if the produced voltage is less than the threshold voltage and for assigning a second binary value if the produced voltage is greater than the threshold voltage.

9. The system of claim 1 wherein said means for sensing the amount of reflected light from the encodings comprises:

a plurality of individual sensing means each located at a distance above a respective encoding appearing on a workpiece holder presented to the automatic sewing machine, the distance of each sensing means above a respective encoding being allowed to vary over a predefined range of spaced distances.

10. The system of claim 9 further comprising:

means for selectively connecting each of said plurality of individual sensing means to said means for assigning a binary value to the sensed amount of light from each of the encodings.

11. The system of claim 9 further comprising:

a plurality of means, each responsive to an individual sensing means, for producing voltage conditions including a first voltage condition indicative of the amount of reflected light from a first type of encoding appearing at the minimum spaced distance from the respective individual sensing means and a second voltage condition indicative of the amount of reflected light from a second type of encoding appearing at the maximum spaced distance from the respective individual sensing means.

12. The system of claim 11 wherein said means for assigning a binary value comprises:

means for defining a threshold voltage between the first and second voltage conditions;

means for comparing the produced voltage conditions from each of said means for producing voltage conditions with the defined threshold voltage; and means, responsive to said comparing means for assigning a first binary value if the produced voltage condition then being compared is less than the threshold voltage and for assigning a second binary value if the produced voltage condition then being compared is greater than the threshold voltage.

13. The system of claim 12 further comprising:

means for selectively connecting each of said plurality of means for producing voltage conditions to said means for comparing the produced voltage conditions with the predefined voltage.

14. A system for optically sensing encodings appearing on workpiece holders being processed by an automatic sewing machine, said system comprising:

a plurality of means for intermittently illuminating the respective encodings at a predefined frequency;

a plurality of sensing means each located at a distance above a respective encoding appearing on a workpiece holder presented to the automatic sewing machine, the distance of each sensing means above a respective encoding being allowed to vary over a predefined range of distances;

a plurality of means, equally spaced from said plurality of means for intermittently illuminating the encodings at a predefined frequency, for continuously illuminating the encodings on a workpiece presented to the automatic sewing machine so as to thereby provide a steady, non varying bias to at least one of said plurality of sensing means; and means, responsive to each of said plurality of sensing means, for assigning a binary value to the sensed amount of reflected light from each encoding.

15. The system of claim 14 further comprising:

means for selectively connecting each of said plurality of individual sensing means to said means for assigning a binary value to the sensed amount of light from each of the encodings.

16. The system of claim 15 wherein said means for assigning a binary value to the sensed amount of reflected light from each of the encodings comprises:

means responsive to said selectively connecting means, for producing an appropriate bi-level signal indicating the assigned binary value immediately prior to termination of the selective connection by said selectively connecting means.

17. The system of claim 14 further comprising:

a plurality of means, each responsive to an individual sensing means, for producing voltage conditions including a first voltage condition indicative of the amount of reflected light from a first type of encoding appearing at the minimum spaced distance from the respective individual sensing means and a second voltage condition indicative of the amount of reflected light from a second type of encoding appearing at the maximum spaced distance from the respective individual sensing means.

18. The system of claim 17 wherein said means for assigning a binary value comprises:

means for defining a threshold voltage between the first and second voltage conditions;

means for comparing the produced voltage conditions from each of said means for producing voltage conditions with the defined threshold voltage; and means, responsive to said comparing means for assigning a first binary value if the produced voltage condition then being compared is less than the threshold voltage and for assigning a second binary value if the produced voltage condition then being compared is greater than the threshold voltage.

19. The system of claim 18 further comprising:

means for selectively connecting each of said plurality of means for producing voltage conditions to said means for comparing the produced voltage conditions with the predefined voltage.

* * * * *